US006470969B1

(12) United States Patent
Sørhaug et al.

(10) Patent No.: US 6,470,969 B1
(45) Date of Patent: Oct. 29, 2002

(54) ARRANGEMENT ON A FLOATING DEVICE FOR OVERHAULING OFFSHORE HYDROCARBON WELLS

(75) Inventors: Lars Martin Sørhaug, Nærsnes; Leif Harald Pettersen, Rolvsøy; Per Herbert Kristensen, Rykkin, all of (NO)

(73) Assignee: Moss Maritime AS, Lysaker (NO)

( * ) Notice: Subject to any disclaimer, the term of this patent is extended or adjusted under 35 U.S.C. 154(b) by 0 days.

(21) Appl. No.: 09/657,820

(22) Filed: Sep. 8, 2000

(30) Foreign Application Priority Data

Sep. 9, 1999 (NO) ..... 19994379

(51) Int. Cl.[7] ..... E21B 43/01; E21B 7/12
(52) U.S. Cl. ..... 166/355; 166/352
(58) Field of Search ..... 166/355, 352

(56) References Cited

U.S. PATENT DOCUMENTS

| | | | | |
|---|---|---|---|---|
| 3,319,981 A | * | 5/1967 | Burgess | 285/302 |
| 3,421,581 A | | 1/1969 | Geijin | |
| 4,617,998 A | * | 10/1986 | Langner | 166/345 |
| 4,694,909 A | * | 9/1987 | Stephenson et al. | 166/359 |
| 4,913,238 A | * | 4/1990 | Danazcko et al. | 166/350 |
| 4,934,870 A | * | 6/1990 | Petty et al. | 405/199 |
| 4,962,817 A | * | 10/1990 | Jones et al. | 175/5 |
| 4,995,762 A | * | 2/1991 | Goldman | 405/195 |
| 5,794,700 A | * | 8/1998 | Pollack | 166/339 |
| 6,000,480 A | | 12/1999 | Eik | 175/8 |

FOREIGN PATENT DOCUMENTS

| | | |
|---|---|---|
| EP | 0 115 938 | 8/1984 |
| GB | 1278986 | 6/1969 |
| GB | 2104128 | 3/1983 |
| GB | 2 343 466 | 5/2000 |
| NO | 123422 | 10/1966 |
| NO | 131352 | 9/1970 |
| NO | 159198 | 6/1982 |

* cited by examiner

*Primary Examiner*—Hoang Dang
(74) *Attorney, Agent, or Firm*—Birch, Stewart, Kolasch & Birch, LLP

(57) ABSTRACT

An arrangement on a floating device for overhauling offshore hydrocarbon wells comprises a drill floor for conducting the overhaul, where the drill floor is provided with an opening. A vertically movable working deck can be inserted into the opening, and is provided with an attachment for a riser which extends from a well to the working deck. The working deck is suspended in the floating device by riser tensioners in order to maintain approximately constant tension in the riser during vertical movement of the floating device.

6 Claims, 2 Drawing Sheets

ARRANGEMENT ON A FLOATING DEVICE FOR OVERHAULING OFFSHORE HYDROCARBON WELLS

FIELD OF THE INVENTION

The invention relates to an arrangement on a floating device for overhauling offshore hydrocarbon wells, comprising a drill floor for conducting the overhauling, where the drill floor is provided with an opening.

DESCRIPTION OF THE BACKGROUND ART

In overhauling hydrocarbon wells, i.e. wells for oil and gas, different tools are employed which are lowered down into the well in a cable or coiled tubing. Occasionally drill strings are also used for overhauling. When overhauling wells which are located below a fixed installation offshore, this overhauling is usually carried out from the fixed installation. When overhauling wells which during their operational phase are not located below any fixed installation, the overhauling is usually carried out from a floating device, which may be a floating drilling platform or a drilling ship.

A well always has a christmas tree with various valves, in which a blow-out preventer forms an integral part. The christmas tree may be located on the seabed, or it may be placed on a platform. A christmas tree with a blow-out preventer which is capable of standing on the seabed can be extremely heavy, and may weigh, for example, 200–250 tons.

An overhaul of an offshore hydrocarbon well with a floating device will often involve an operation where a christmas tree with a blow-out preventer is lowered to the seabed from the floating device. For this reason the floating device's drill floor may have an opening into which the christmas tree can be inserted for lowering. When the opening is not being used for this purpose, a deck section can be placed in the opening.

When overhauling an offshore well with a floating device according to prior art, a riser is usually placed between the well and the floating device. On account of the motion of the sea, the floating device will normally move vertically in the sea, and in order to avoid damage to the riser it is important that this vertical movement should not be transferred to the riser. For this purpose motion compensators, so-called riser tensioners, are usually employed, which are attached to the floating device and the riser, keeping a uniform tension on the riser independently of the vertical movement of the floating device. The end of the riser, on which an injector head may be placed for insertion of coiled tubing, or another device to which access is required, thereby remains at rest, while the drill floor on the floating device moves in a vertical direction. The maximum vertical movement of the floating device may be 6 meters, and it can therefore be very difficult for personnel located on the drill floor to perform work on devices at the end of the riser.

Norwegian patents No. 123422 and 131352 relates to an offshore construction comprising a vertically movable working deck which is provided with attachment means for a riser which extends from a well to the working deck, where the working deck is kept at an approximately constant level with heave-compensating means.

BRIEF SUMMARY OF THE INVENTION

The object of the invention is to provide an arrangement on a floating device for overhauling offshore hydrocarbon wells, which makes it possible in a practical manner to gain access to the end of the riser which extends from the well to the floating device, even when the floating device is moving vertically relative to the riser.

The object is achieved according to the invention with an arrangement of the type mentioned in the introduction.

Thus the invention relates to an arrangement on a floating device for overhauling offshore hydrocarbon wells, comprising a drill floor for conducting the overhaul, where the drill floor is provided with an opening. A vertically movable working deck which is provided with attachment means for a riser which extends from a well to the working deck can be inserted in the opening. The working deck is suspended in the floating device with riser tensioners in order to maintain an approximately constant tension in the riser during vertical movement of the floating device.

When overhauling a well with a floating device by means of the invention, the riser is attached to the working deck by the attachment means, and the working deck and the riser thereby acquire the same vertical movement relative to the floating device. Personnel who have to carry out work on the end of the riser take their places on the working deck, and the problem of the end of the riser moving relative to the personnel who have to perform the work is thereby solved.

Since it is the relative motion between the riser and the floating device, and not the absolute motion which is the problem in known floating devices, the working deck and the riser are referred to at some places in the following description as vertically movable where this is considered to be most appropriate.

In the invention a known type of floating device is employed, viz. a floating device with an opening in the drill floor. This device may be a floating drilling platform or a drilling ship. As already mentioned, according to prior art an opening of this kind can be used for lowering a christmas tree to the seabed or a deck section.

Riser tensioners will normally be found on a floating device of this type. The working deck can thereby be given a motion-compensated suspension without the need for a comprehensive installation of extra equipment, which is advantageous with regard to space and economy.

Further preferred embodiments, objects and advantages of the invention will be set forth in the detailed part of the description.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE INVENTION

The invention will now be explained in more detail in connection with a description of a specific embodiment, and with reference to the drawings which are given by way of illustration only, and thus are not limitative of the present invention, and in which.

DETAILED DESCRIPTION OF THE INVENTION

Figure 1:
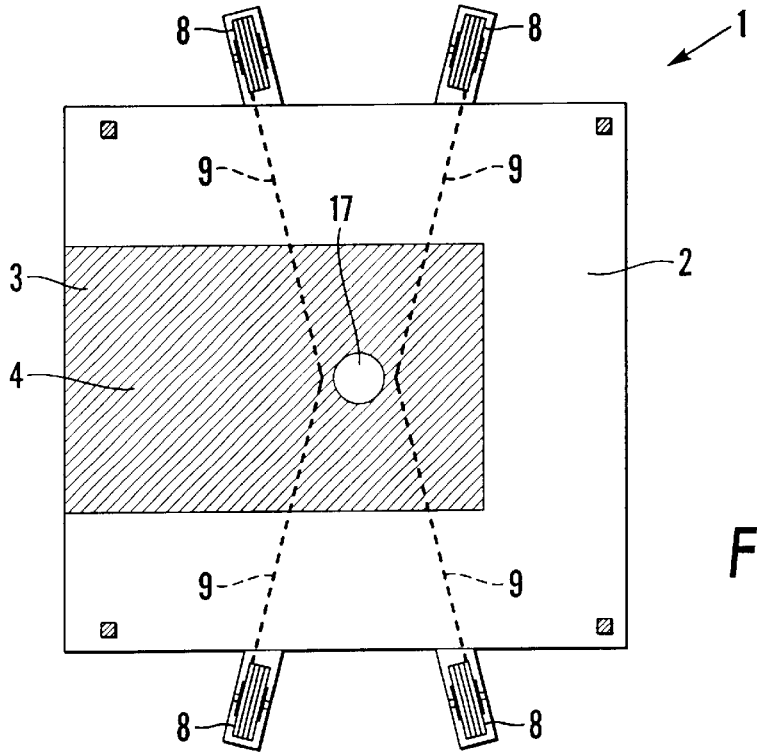
FIG. 1 is a top view of a drill floor on a known floating device.

FIG. 1 is a top view of a drill floor 2 on a known floating device in the form of a drilling platform which is intended for offshore well drilling. The drill floor 2 is the main deck on the drilling platform 1, forming the foundation for a derrick, which is not illustrated in FIG. 1. The derrick is located above an opening 17 for a not illustrated drill string.

The drilling platform 1 can also be employed for overhauling offshore hydrocarbon wells. A riser is then placed between a wellhead which is located down on the seabed and the drill floor 2. The actual overhaul of the well consists in the performance of operations down in the well, such as putting down plugs or opening or closing valves, which is done by coiled tubing, a cable or a drill string which is lowered into the well through the end of the riser.

As mentioned at the beginning, the riser must be kept stationary during the drilling platform's vertical movement in the sea. When overhauling according to prior art, therefore, the riser is attached to wires 9 which are passed from the area at the opening 17 to riser tensioners 8, which compensate for the drilling platform's vertical movement while maintaining an approximately constant tension in the wires 9 and consequently the riser.

Overhauling according to prior art is performed by personnel located on the drill floor 2. The drilling platform's vertical movement, however, causes the drill floor 2 to move vertically relative to the end of the riser, and it is therefore difficult to carry out work on the end of the riser.

The drill floor 2 is of the said type which has an opening 3 into which a christmas tree (not illustrated) can be inserted for lowering, and where a deck section 4 can be inserted when the opening 3 is not being used for lowering the christmas tree.

In addition, the drilling platform comprises a quantity of auxiliary equipment and structures, such as propulsion machinery, a recreation room for personnel, hoisting cranes, ladders, diesel tanks, floats and other items necessary for the operation of the drilling platform, but which are of no significance for the description of the invention, and consequently will not be described further.

Figure 2:
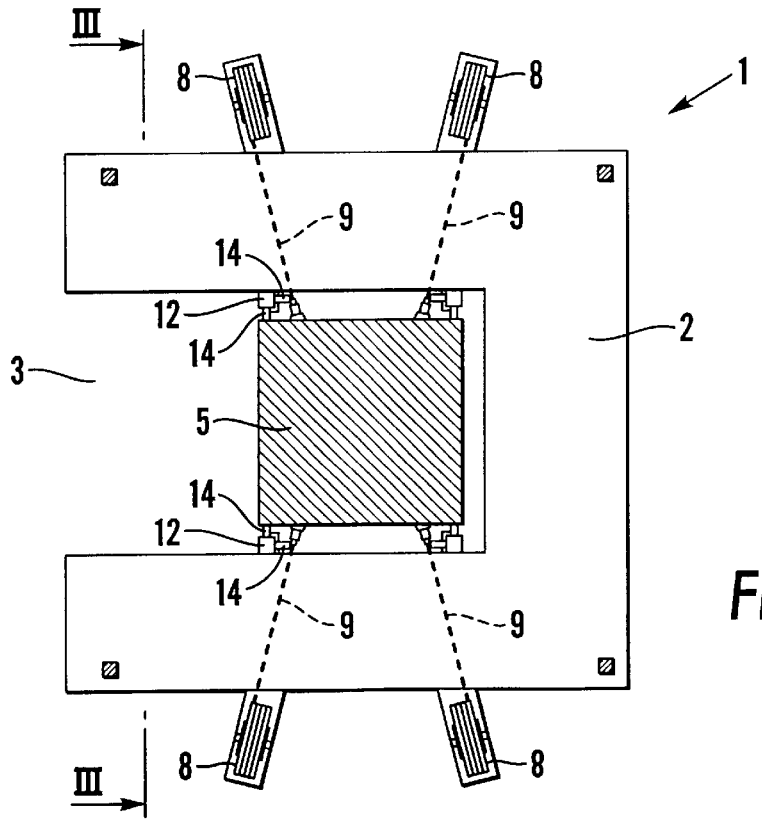
FIG. 2 illustrates the drill floor in FIG. 1 with a working deck according to the invention.

FIG. 2 is a top view of the drill floor 2 with a working deck 5 according to the invention. The deck section 4 is removed here, and the working deck 5 has taken the deck section's place in the opening 3.

Figure 3:
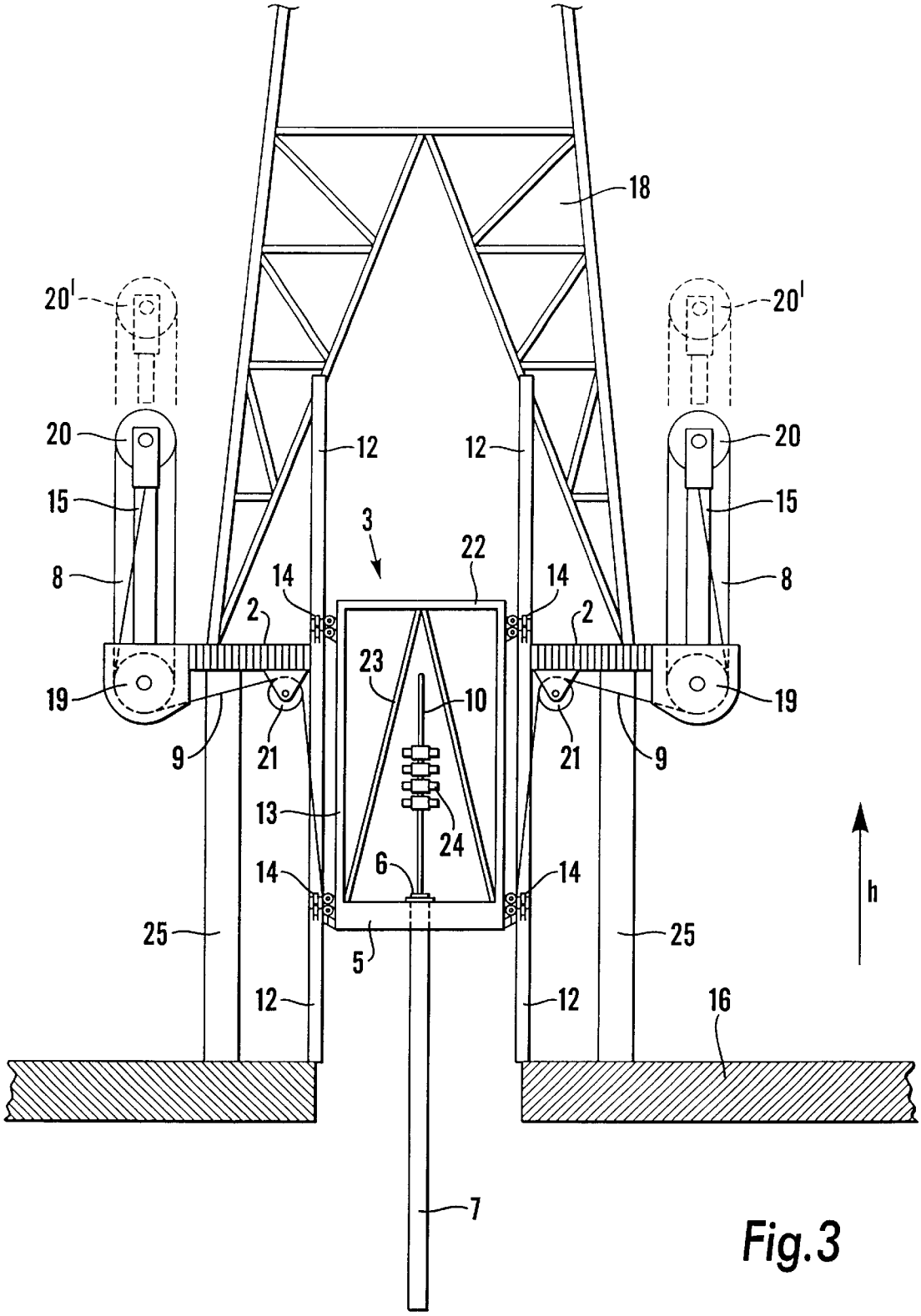
FIG. 3 illustrates a cross section through the drill floor in FIG. 2, taken along intersecting line III—III in FIG. 2.

FIG. 3 illustrates a cross section through the drill floor in FIG. 2, taken along the intersecting line III—III in FIG. 2. The working deck 5, the drill floor 2 and other parts of the drilling platform are viewed from the side here. A derrick 18 can be seen which is located on the drill floor 2. A cellar deck 16 is further illustrated which is located below the drill floor 2 and is connected to the drill floor by drill floor legs 25.

The working deck 5 is provided with attachment means 6 for the riser 7. The attachment means 6 are illustrated in a simplified form, and may be composed of a collar on the riser and a corresponding holding piece in the working deck 5. The attachment means 6 may also consist of clamping jaws which hold the riser 7 securely in the working deck 5. One end 10 of the riser projects above the working deck 5, and is provided with valves 24, through which the overhaul of the well is performed.

The working deck 5 is vertically movable up and down relative to the drill floor 2, the vertical direction being indicated by the arrow h, which points upwards. In the illustrated embodiment the working deck is laterally secured by guide members 12, for example rails, which are connected to the drilling platform, and which co-operate with guide rollers 14 which are securely attached to the working deck 5. In the illustrated embodiment the guide members 12 are connected both to the drill floor 2 and the cellar deck 16. The working deck 5 is composed of, or more correctly is covered by, a vertically extending frame 13, which comprises upper beams 22 and diagonal braces 23. The guide rollers 14 for engagement with the guide members 12 are mounted at a vertical distance apart from one another, thus achieving a stable construction.

The working deck 5 is suspended in the drilling platform 1 by the riser tensioners 8. Both the working deck 5 and the end 10 of the riser thereby remain stationary when the drilling platform 1 with the drill floor 2 move up and down in the sea. Personnel who have to carry out work on the end 10 of the riser take their places on the working deck 5, and can thereby perform the work without the end 10 of the riser moving relative to the location in which the personnel are standing.

The riser tensioners 8 constitute a part of the drilling platform's 1 permanent equipment. Each riser tensioner 8 comprises a hydraulic cylinder 15 which acts between an upper movable tension sheave 20 and a lower fixed guide sheave 19. A wire 9 extends round the tension sheave 20 and the guide sheave 19, and may be passed several times between the sheaves. From the guide sheaves 19 the wires 9 are passed under the drill floor 2 to guide pulleys 21, and from there to the working deck 5, where they are secured, with the result that the working deck 5 is suspended in the wires 9. This is the same arrangement of the wires as that used when the riser tensioners are employed to put a riser under direct tension, without the use of the working deck 5, and thus it is not necessary to make changes to the riser tensioners when they are used to support the working deck 5. This arrangement of the wires 9 permits the working deck 5 to be raised to the underside of the drill floor 2.

When the drilling platform 1 is at rest, the tension in the wires 9 is in balance with the hydraulic pressure in the cylinders 15, and the riser tensioners and the wires are at rest.

When the drilling platform 1 moves in a vertical direction it results in either an increased tension or a relief of tension in the riser 7, which is transmitted via the wires 9 to the hydraulic cylinders 15, resulting in a pressure rise or pressure drop therein. Devices for maintaining an approximately constant hydraulic pressure in the hydraulic cylinders 15, for example gas accumulators and valves which via a control system are controlled by pressure sensors in the hydraulic cylinders, supply or remove hydraulic oil to and from the cylinders, thus causing the hydraulic cylinders to be moved out or in. The upper tension sheaves thereby move between the illustrated positions 20 and positions indicated by dotted lines 20', thus causing the wires 9 to be pulled in or paid out until the tension in the wires is again in balance with the hydraulic pressure in the cylinders 15. The tension in the wires 9 is transmitted to the working deck 5, and thereby the riser 7, with the result that the tension in the riser is kept approximately constant.

It can be seen that the riser tensioners 8 are four in number. The riser tensioners 8 act on the working deck 5 in parallel, thereby causing a uniform power distribution on the working deck. In addition the use of a plurality of riser tensioners in parallel leads to increased safety if one riser tensioner should cease to function.

For access to the working deck 5, a vertically movable access platform may be employed, and devices for optional movement of the access platform either together with the drilling platform 1, together with the working deck 5, or something between these movements. This access platform is not illustrated in the figures. The access platform may be guided laterally by the same guide members 12 as the working deck 5, or it may be guided laterally in separate guide members. The devices for optional movement of the access platform either together with the drilling platform, together with the working deck, or something between these movements, may comprise a winch device where the access platform is suspended, and which is controlled by a control system which via suitable sensors receives information concerning the working deck's 5 movement relative to the drilling platform 1.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An arrangement on a floating device for overhauling offshore hydrocarbon wells, comprising a vertically movable working deck which is provided with attachment means for a riser which extends from a well to the working deck, where the working deck is kept at an approximately constant level with heave-compensating means, the floating device comprises a drill floor for conducting the overhaul, the drill floor is provided with an opening, the working deck is inserted in the opening and the working deck is suspended in the floating device with riser tensioners for maintaining approximately constant tension in the riser during vertical movement of the floating device.

2. The arrangement according to claim 1, wherein the riser tensioners comprise a plurality of riser tensioners which act in parallel on the working deck.

3. The arrangement according to claim 1, further comprising wires passed from the riser tensioners to the working deck via the underside of the drill floor, thus enabling the working deck to be raised to the underside of the drill floor.

4. The arrangement according to claim 1, further comprising guide members for the working deck's vertical movement, the guide members being connected to the drill floor.

5. The arrangement according to claim 1, further comprising guide members for the working deck's vertical movement, the guide members being connected to a cellar deck which is located below the drill floor.

6. The arrangement according to claim 1, wherein the working deck is composed of a vertically extending frame, with guide rollers for engagement with guide members for the working deck's vertical movement mounted at a vertical distance apart from one another.

* * * * *